US005151705A

United States Patent [19]

Badger et al.

[11] Patent Number: 5,151,705

[45] Date of Patent: Sep. 29, 1992

[54] SYSTEM AND METHOD OF SHAPING AN ANTENNA RADIATION PATTERN

[75] Inventors: Scott L. Badger, Renton; John P. Braun, Issaquah; Sperry H. Goodman, Kent, all of Wash.

[73] Assignee: Boeing Aerospace and Electronics, Seattle, Wash.

[21] Appl. No.: 656,276

[22] Filed: Feb. 15, 1991

[51] Int. Cl.[5] ..... H01Q 3/22

[52] U.S. Cl. ..... 342/368; 342/371

[58] Field of Search ..... 342/368, 379, 371, 372

[56] References Cited

U.S. PATENT DOCUMENTS 3,001,196 9/1961 McIlroy et al. .
3,176,302 3/1965 Tipton .
3,803,624 9/1972 Kinsey .
4,045,800 5/1975 Tang et al. .
4,052,723 4/1976 Miller .
4,090,204 9/1976 Farhat .
4,179,683 12/1979 Hildebrand et al. .
4,335,388 6/1982 Scott et al. .
4,376,940 3/1983 Miedema .
4,458,247 7/1984 Amitay ..... 342/368
4,571,594 2/1983 Haupt .

FOREIGN PATENT DOCUMENTS 57-145405 9/1991 Japan .

OTHER PUBLICATIONS

Chestin, Phased-Array Antennas, Beam Steering of Planar Phased Arrays, pp. 219-221, 1972.

*Primary Examiner*—Gregory C. Issing
*Attorney, Agent, or Firm*—Finnegan, Henderson, Farabow, Garrett & Dunner

[57] ABSTRACT

An antenna having decreased sidelobes relative to the mainlobe. In the preferred embodiments, the antenna reduces sidelobes by using the sidelobes within an array to cancel the sidelobes of a corresponding, symmetrically related, array.

34 Claims, 18 Drawing Sheets

SYSTEM AND METHOD OF SHAPING AN ANTENNA RADIATION PATTERN

BACKGROUND OF THE INVENTION

1. Field of the Invention

This invention relates to a system and method for shaping an antenna radiation pattern, and more particularly to a system and method of sidelobe reduction in the principal planes.

2. Description of Related Art

An antenna is a structure for transmitting or receiving radiowaves. It is typically desirable for an antenna to have isolation from antennas other than antennas in a particular direction. In general the particular direction will be towards a target antenna. For many applications, effective isolation means that it is desirable for the antenna to have a particular beam shape, e.g., a shape with selected side lobe suppression.

If the antenna is transmitting, appropriate side lobe suppression makes it less likely that the antenna will interfere with the operation of other antennas. If the antenna is receiving, such suppression makes it less likely that the antenna will be susceptible to interference from other antennas. In an environment where interference from other antennas may be intentional, such as an environment where there is jamming of radar or communication systems, side lobe suppression may be an important part of an electronic counter measures capability.

It may desirable to suppress side lobes in a certain plane of the radiation pattern of an antenna. In an environment where both the target antenna and the other antennas are on a common horizon, for example, sidelobes should be suppressed in a principal plane aligned with the horizon One principal plane of an antenna is that plane containing both the electric field vector and the direction of maximum radiation. Another principal plane is that plane containing both the magnetic field vector and the direction of maximum radiation.

Another environment where it is desirable to suppress sidelobes in a certain plane is in a geosynchronous orbit satellite communication system. Assuming ground antennas are located at the equator, sidelobes should be suppressed in a principal plane aligned with the equator. If the ground antennas are not located at the equator, side lobe suppression in a principal plane still provides isolation from the other antennas when the other antennas are located relatively close together.

An example of a planar array system is shown in FIG. 1(*a*). This example consists of a radio signal processor 120, a feed network 130, and an antenna array 170 consisting of 199 columns of elements in azimuth and 39 rows of elements in elevation. A front view of array 170 is shown in FIG. 1(*a*) and a top view in FIG. 1(*b*). The system of FIGS. 1(*a*)-(*b*) has a −50 dB Taylor Distribution, Nbar=10, and an element spacing of 0.5 wavelengths with Cos(Theta) element factor. FIG. 2(*a*) is a plot of a radiation pattern of the depicted antenna. FIG. 2(*a*) shows a radiation pattern in a principal plane having a varying azimuth and running parallel to each set of 199 elements. The horizontal axis in FIG. 2(*a*) is the angle relative to an axis perpendicular to the center of the array, with 0 degrees looking straight out of the center of the array. The highest peak centered about the azimuth of zero degrees is called the main lobe. The peaks on either side of the mainlobe are sidelobes. It is desirable for sidelobes to be small or well-controlled relative to the main lobe.

FIG. 2(*b*) is a plot of another principal plane pattern, perpendicular to that of FIG. 2(*a*). FIG. 2(*b*) shows a radiation pattern of the planar array in a principal plane having a varying elevation, with 0 degrees looking straight out of the center of the array.

FIG. 2(*c*) is a three-dimensional grid contour from −20 to +20 degrees in both azimuth and elevation. As can be seen from FIG. 2(*c*), the main areas of sidelobe energy are located in two bands centered on the principal planes of the antenna. The antenna radiation patterns depicted in FIGS. 2(*a*)-(*c*) are the result of constructive and destructive interference between the elements of the antenna.

There have been a few methods developed for reducing sidelobe energy. One method involves amplitude tapering, in which the amplitude of the elements in the center of the array is high relative to the elements near the periphery. Amplitudes are set at the design level for sidelobes next to the main beam and taper off with an approximate sin x/x dependency from there out to the periphery of the array. The radiation patterns shown in FIGS. 2(*a*)-(*c*) are the result of amplitude tapering. As described earlier, this means that the highest sidelobes are in the principal planes and adjacent to the main beam.

Other methods of reducing sidelobes are typically achieved through the use of a sidelobe canceller or adaptive nulling.

OBJECTS AND SUMMARY OF THE INVENTION

It is an object of the present invention to reduce sidelobes of an antenna radiation pattern in the principal planes and adjacent to the main beam.

To achieve these and other objects of the invention, an antenna having N subantennas, N being at least 3, each subantenna having a pattern having a main lobe and sidelobes on opposite sides of the main lobe, each pattern lying in a plane parallel to, and removed from, a pattern of an adjacent subantenna, comprises a first subantenna; a second subantenna; first means for pointing the pattern of the second subantenna at a non-zero angle relative to the pattern of the first subantenna; an Nth subantenna; (N−1)th means for pointing the pattern of the Nth antenna at the non-zero angle relative to the pattern of the (N−1)th antenna.

According to another aspect of the invention, an antenna having N subantennas, N being at least 3, each subantenna having a pattern having a main lobe and sidelobes on opposite sides of the main lobe, each pattern lying in a plane parallel to, and removed from, a pattern of an adjacent subantenna, comprises a first subantenna; a second subantenna; first means for pointing the pattern of the second antenna at a non-zero angle relative to the pattern of the first subantenna; an Nth subantenna; (N−1)th means for pointing the pattern of the Nth antenna at the non-zero angle relative to the pattern of the (N−1)th antenna. Each subantenna further includes a linear array of elements each having a longitudinal axis of length L, and the antenna further includes means coupled to the linear arrays, for processing radio signal having a center operating frequency, and a wavelength W corresponding to the center operating frequency, wherein the non-zero angle is ARC- SIN (DW/(L/2)) divided by (((N+1)/2)−1), wherein N is an odd number and D is a positive integer.

According to still another aspect of the invention, an antenna having N subantennas, N being at least 3, each subantenna having a pattern having a main lobe and sidelobes on opposite sides of the main lobe, each pattern lying in a plane parallel to, and removed from, a pattern of an adjacent subantenna, comprises a first subantenna; a second subantenna; first means for pointing the pattern of the second antenna at a non zero angle relative to the pattern of the first subantenna; an Nth subantenna; (N−1)th means for pointing the pattern of the Nth antenna at the non zero angle relative to the pattern of the (N−1)th antenna; and an axis common to each of the N subantennas. Each subantenna further includes a linear array of elements each having 2 endpoints and a longitudinal axis of length L between the endpoints normal to the common axis having a midpoint intersecting the common axis, wherein the antenna further includes means, coupled to the linear arrays, for processing a radio signal having a center operating frequency, and a wavelength W corresponding to the center operating frequency; and a nominal plane, defined by the common axis and the longitudinal axis of the (N+1)/2 th array, wherein the non-zero angle is selected so that the corners of the antenna will be separated from the nominal plane by a distance of DW, wherein D is a positive integer.

According to still another aspect of the invention, in an antenna having N subantennas, N being at least 3, each subantenna having a pattern having a main lobe and sidelobes on opposite sides of the main lobe, each pattern lying in a plane parallel to, and removed from, a pattern of an adjacent subantenna, each subantenna including a linear array of elements each having 2 endpoints and a longitudinal axis of length L between the endpoints normal to the common axis having a midpoint intersecting the common axis, wherein the antenna further includes means, coupled to the linear arrays, for processing a radio signal having a center operating frequency, and a wavelength W corresponding to the center operating frequency, an axis common to each of the N subantennas, and a nominal plane, defined by the common axis and the longitudinal axis of the (N+1)/2 th array, a method of operating the antenna comprises the steps of pointing the pattern of a second antenna at a non zero angle relative to the pattern of a first subantenna; and pointing the pattern of the Nth antenna at the non zero angle relative to the pattern of the (N−1)th antenna, wherein the non-zero angle is selected so that the corners of the antenna will be separated from the nominal plane by a distance of DW, wherein D is a positive integer.

The accompanying drawings, which are incorporated in and which constitutes a part of this specification, illustrate preferred embodiments of the invention and, together with the description, explain the principles of the invention.

BRIEF DESCRIPTION OF DRAWINGS

FIG. 1(*b*) is a top view corresponding to FIG. 1(*a*).

FIG. 2(*b*) is a simulated radiation pattern of the example system in a principal plane showing variation in amplitude with elevation angle.

FIG. 2(*c*) is a three-dimensional grid contour simulated radiation pattern of the planar array varying in both azimuth and elevation angles.

FIG. 3(*b*) is a top view corresponding to FIG. 3(*a*).

FIG. 4(*b*) is a simulated radiation pattern of the first preferred embodiment in a principal plane showing variation in amplitude with elevation angle.

FIG. 4(*c*) is a three dimensional grid contour of a simulated radiation pattern of the first embodiment varying in both azimuth and elevation angles.

FIG. 5(*b*) is a simulated radiation pattern of the second preferred embodiment in a principal plane showing variation in amplitude with elevation angle.

FIG. 6(*b*) is a simulated radiation pattern of the other example planar array in a principal plane showing variation in amplitude with elevation angle.

FIG. 9(*b*) is a simulated radiation pattern of the third preferred embodiment in a principal plane showing variation in amplitude with elevation angle.

DETAILED DESCRIPTION OF THE PREFERRED EMBODIMENTS

Figure 3A:
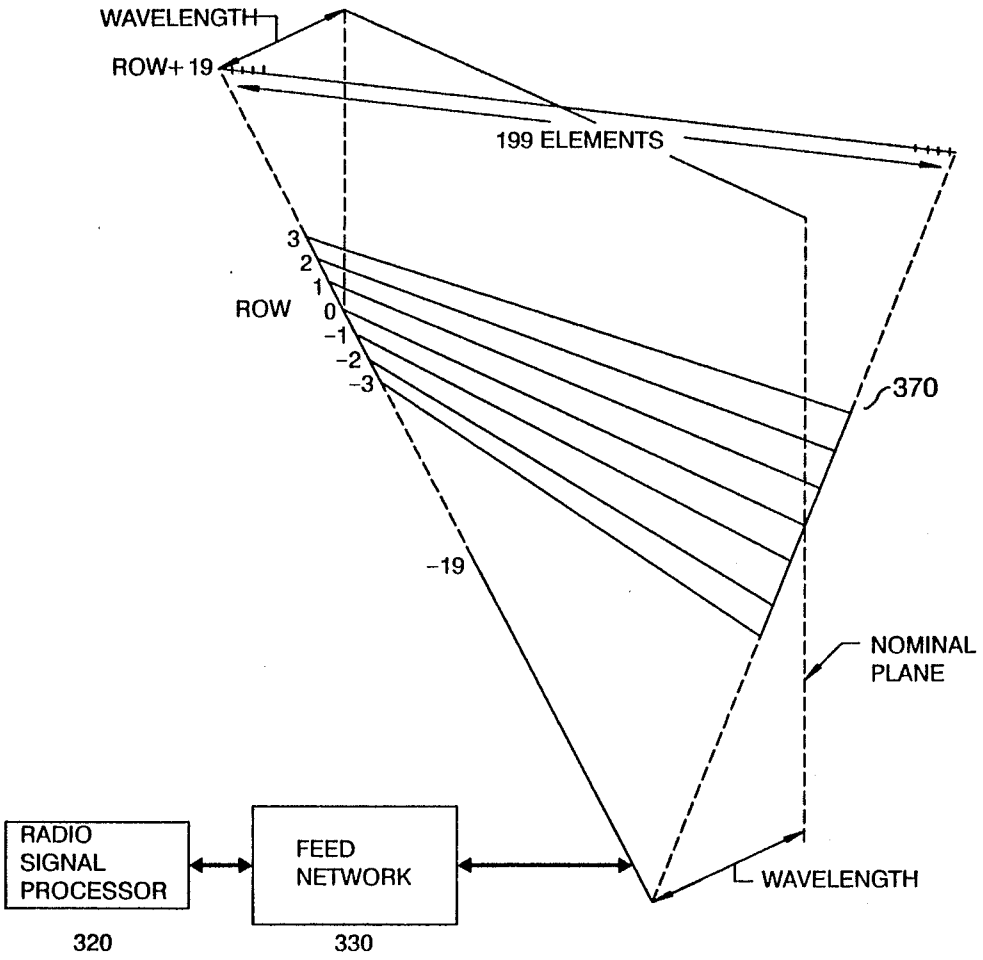
FIG. 3(*a*) is a schematic diagram of an antenna system according to a first preferred embodiment of the present invention.
Figure 3B:
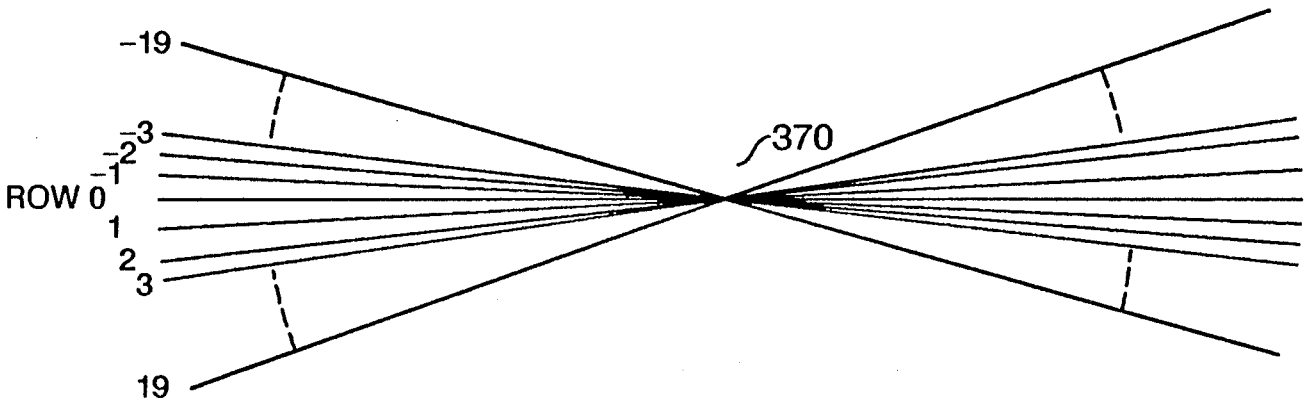

FIG. 3(*a*) is a schematic diagram of an antenna system according to a first preferred embodiment of the present invention. The first preferred embodiment is an improvement of a conventional planar array system and includes a radio signal processor 320, a feed network 330, and an antenna 370, comprising a plurality of rows of antenna elements. In this and other preferred embodiments of the present invention, each row of antenna elements constitutes a subantenna comprising a linear array. As can be seen in FIG. 3(*a*) the longitudinal axis of each row of antenna 370 is positioned at a non-zero angle relative to the axis of an adjacent row. FIG. 3(*b*) is a schematic top view of antenna 370.

A nominal plane of the antenna can be defined by the longitudinal axis of row 0 (the center row) and an axis passing through the middle portions of the rows, as shown in FIG. 3(*a*). This nominal plane is an imaginary plane corresponding to a physical plane of a planar array. In the first preferred embodiment, the non-zero angle is selected so that the ends of the first and last rows of the array are separated from the nominal plane by a wavelength at the center operating frequency.

Antenna 370 of the first preferred embodiment has 39 rows numbered −19 to +19, including 199 elements per row. The ends of the first and last, −19th and +19th, rows will be separated from the nominal plane by approximately one wave length. The relative angle between rows that will achieve this separation is a function of the length (longitudinal dimension), and number, of the rows. In the first preferred embodiment, if the length of each row were 99 wave lengths, the relative angle between rows would be 0.06 degrees.

In other words, the antenna of the first preferred embodiment includes an axis common to each of N subantennas, N being an odd number (39), and each subantenna is a linear array including a longitudinal axis of length L normal to the common axis having a midpoint intersecting the common axis, and 2 endpoints. There is a means, coupled to the linear arrays, for processing a radio signal having a center operating frequency, and a wavelength W corresponding to the center operating frequency. The non-zero angle is ARCSIN (W/(L/2)) divided by (((N+1)/2)−1).

The preferred embodiments of the invention have a center operating frequency in the range of the L-Band (390Mhz to 1.5Ghz) a −50 dB Taylor Distribution, Nbar=10, and an element spacing of 0.5 wavelengths with Cos(Theta) element factor.

With the antenna of the first preferred embodiment, symmetrically located rows, constituting a similar pair, on either side of row 0 are oriented at conjugate angles relative to the principal plane. More specifically, one row of a pair has an orientation angle having equal magnitude and opposite sign of the orientation angle of the other similar row of the pair.

In other words, the antenna has a center axis normal to the common axis and lying in the nominal plane, and for each subantenna having a non-zero displacement C from the center axis and having a radiation pattern biased at an angle A relative to the nominal plane, there is a similar subantenna having a displacement −C from the center axis and having a radiation pattern biased at an angle −A relative to the nominal plane.

This conjugate orientation of symmetrically positioned rows capitalizes on the fact that adjacent sidelobes within the radiation pattern of each row are 180° out of phase relative to each other. The sidelobes of the rows of the array above row 0 destructively interfere with the sidelobes of the rows below row 0 in the principal plane parallel to row 0. The first preferred embodiment could also be described as pointing the broadside pattern of the rows so that the resulting radiation pattern has reduced coherency of the sidelobes in the principal planes. Because the main beam of the broadside radiation pattern of each row is substantially broader than the sidelobes, the main beam of the antenna does not lose coherency as easily as do the close in sidelobes.

Note that the ends of the first and last columns of the array are also separated from the principal plane by a wavelength at the center operating frequency. The discussion above could have been phrased in terms of relative angles between columns, taking into account the length of each column.

Figure 1A:
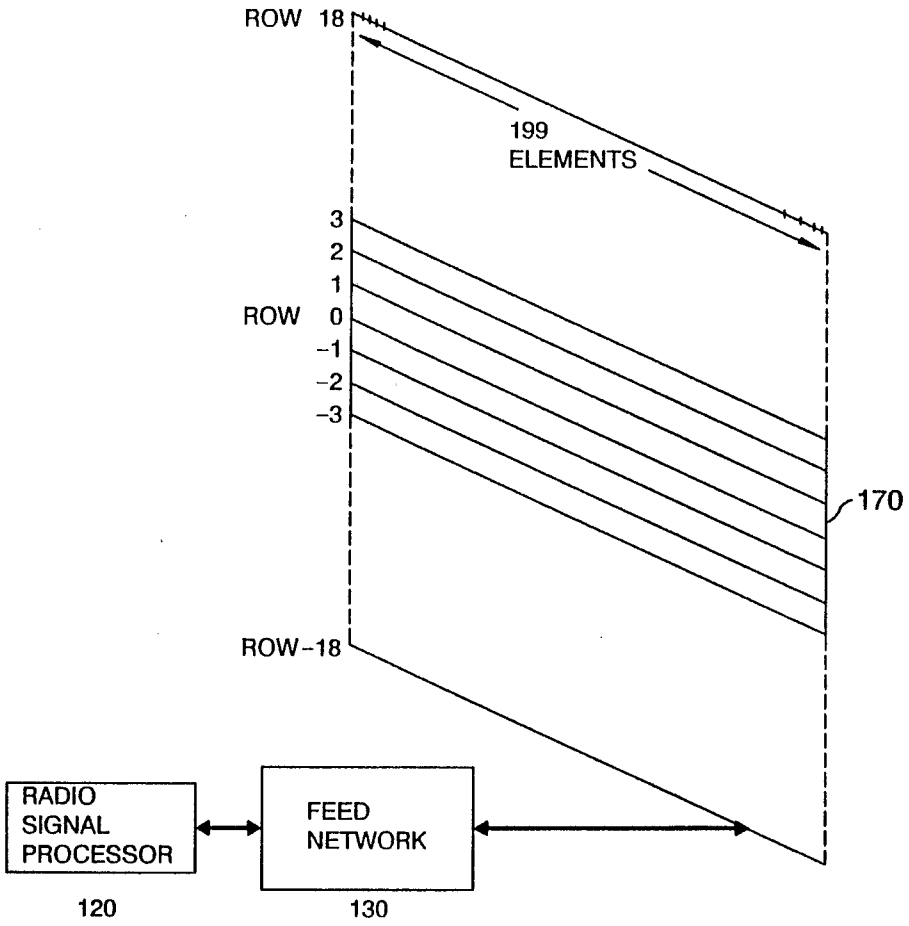
FIG. 1(*a*) is a schematic diagram of an example planar array system.
Figure 1B:
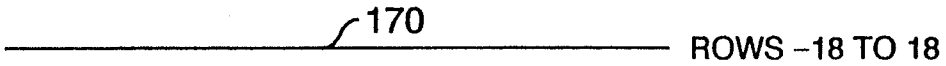
Figure 2A:
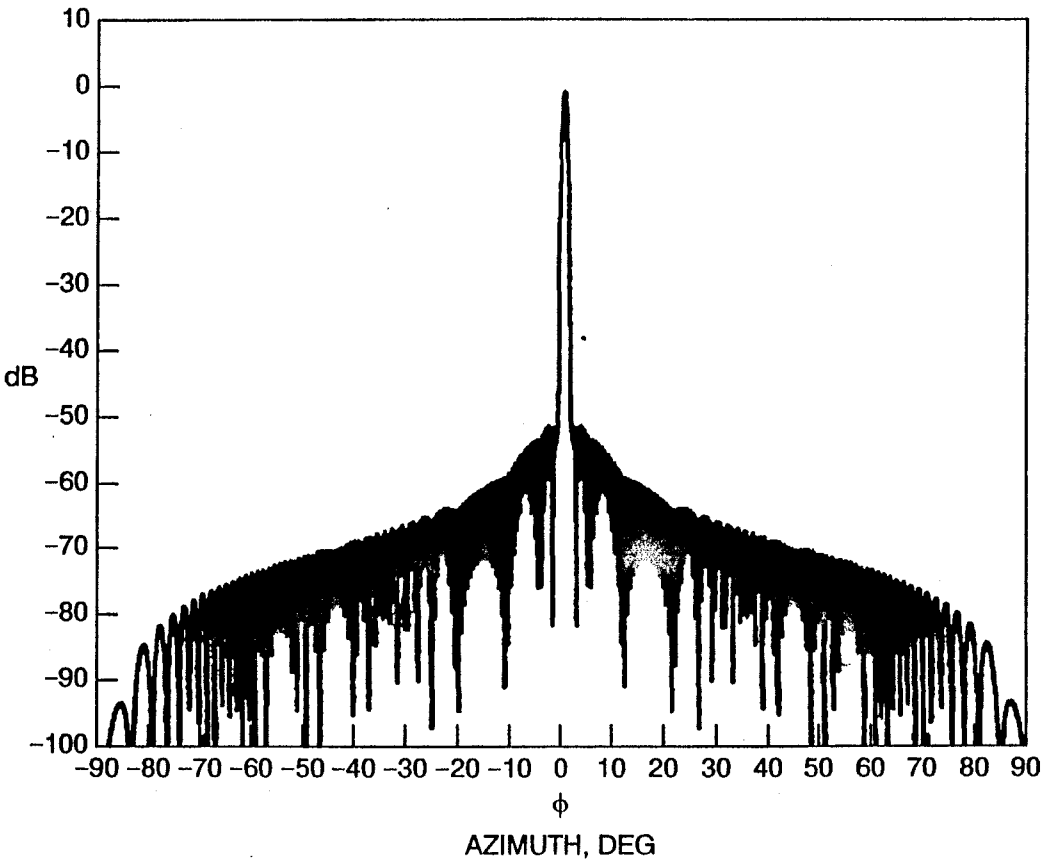
FIG. 2(*a*) is a simulated radiation pattern of the example system in a principal plane showing variation in amplitude with azimuth angle.
Figure 2B:
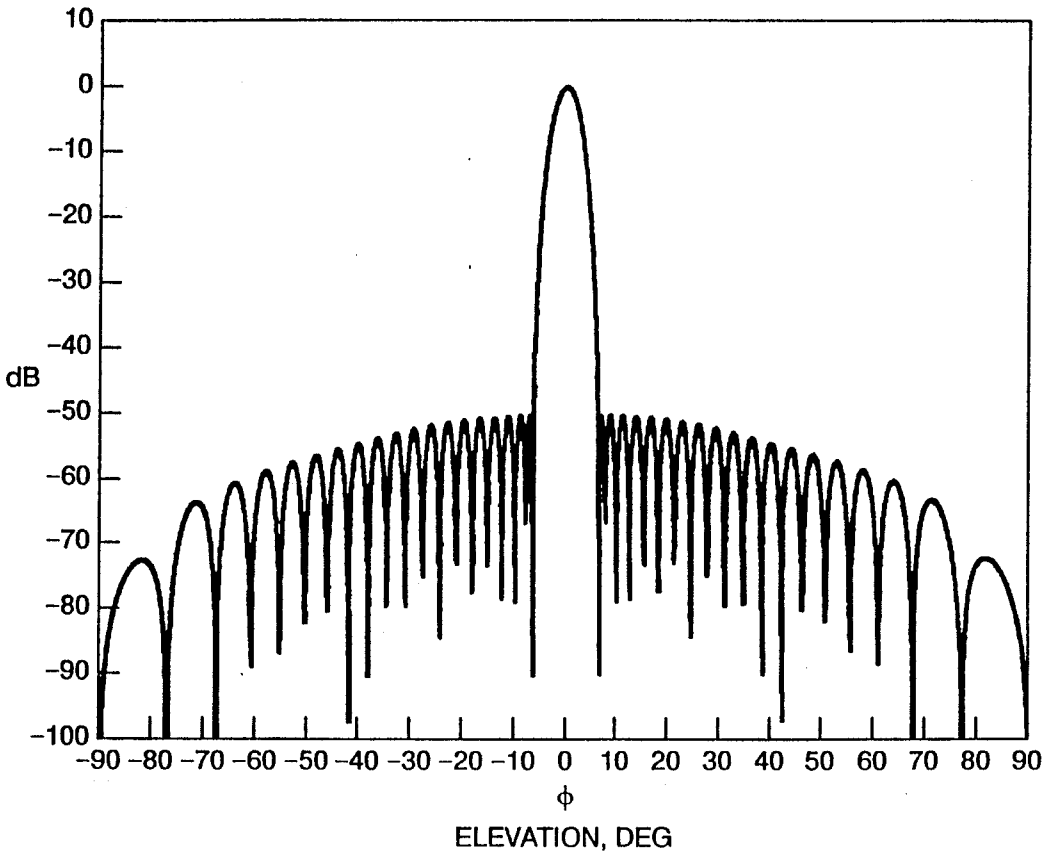
Figure 2C:
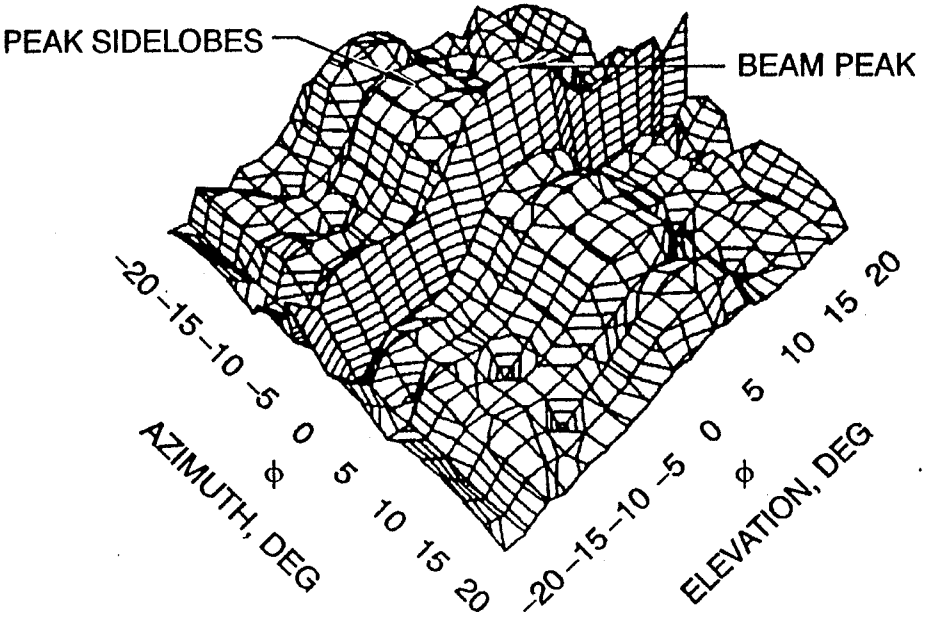
Figure 4A:
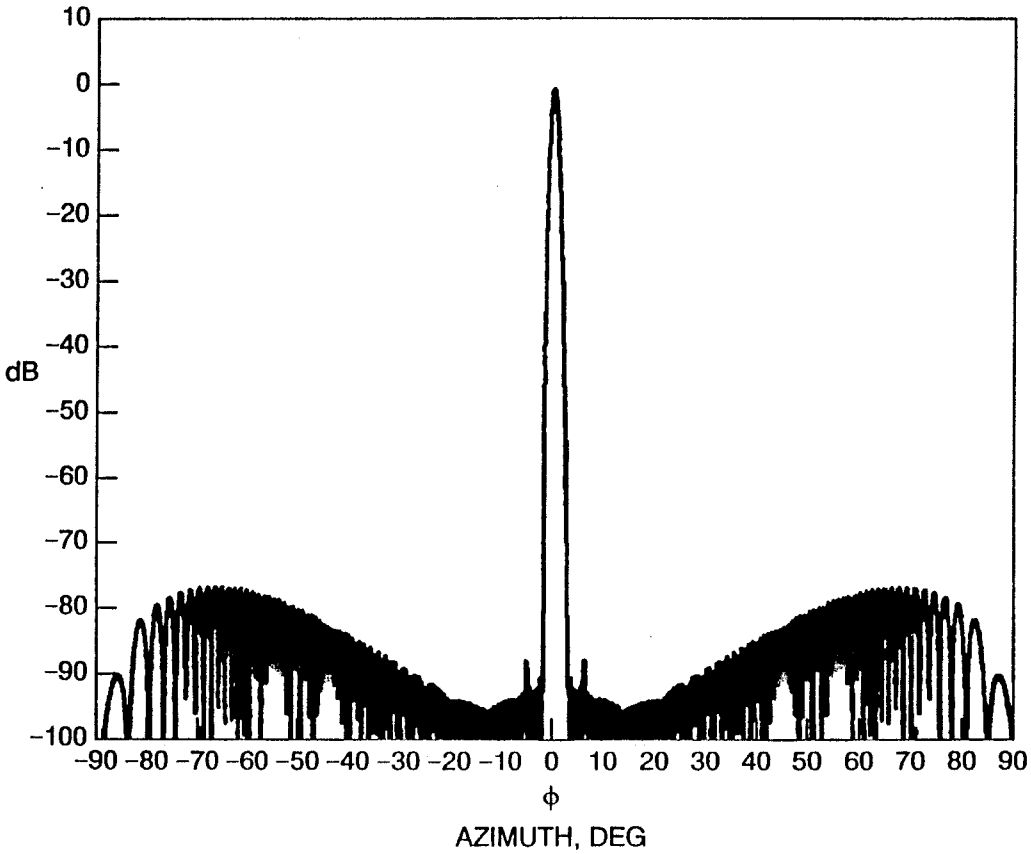
FIG. 4(*a*) is a simulated radiation pattern of the first preferred embodiment in a principal plane showing variation in amplitude with azimuth angle.
Figure 4B:
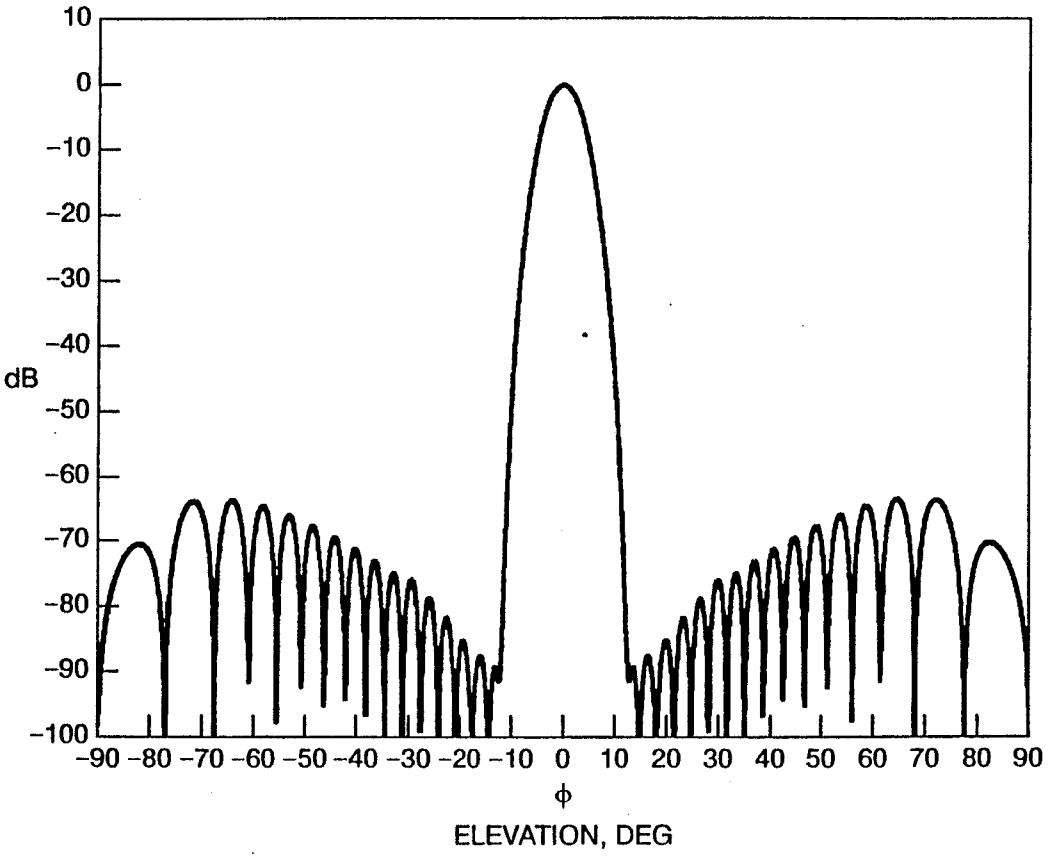
Figure 4C:
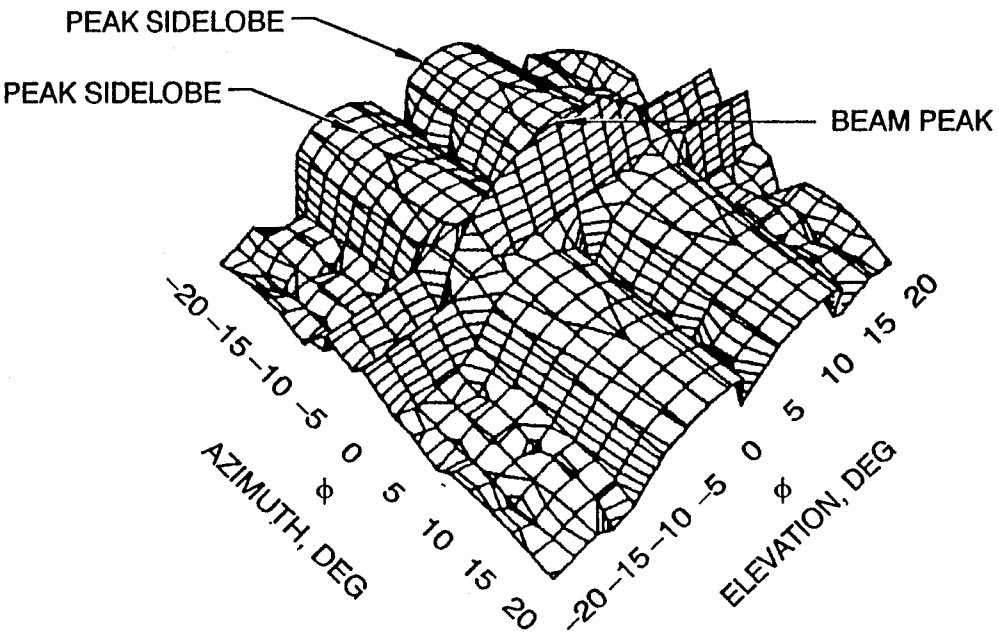

FIGS. 4(*a*)-(*b*) are plots of the radiation patterns of the first preferred embodiment in the two principal planes. In contrast with FIGS. 2(*a*)-(*b*) discussed in the background of the invention, the principal plane sidelobes have been greatly reduced, particularly near the main beam. The main beam has broadened, thus dropping the gain of the antenna, but the sidelobes have dropped considerably more (−85dB vs −50dB) than the gain.

FIG. 4(*c*) is a three-dimensional grid contour from −20 to +20 degrees in both azimuth and elevation of the first preferred embodiment. In contrast with FIG. 2(*c*) discussed in the BACKGROUND OF THE INVENTION, FIG. 4(*c*) shows that the sidelobes have been pushed out into two wide bands on either side of the principal planes.

All the radiation patterns depicted in this application, including the radiation patterns of FIGS. 4(*a*)-(*c*), were derived from computer simulations. In the radiation patterns, the various amplitudes correspond to the intensity of transmitted power in a certain direction, when the radio signal processor is transmitting. Conversely, the various amplitudes correspond to sensitivity to radio signals originating from a certain direction, when the radio signal processor is receiving.

Figure 5A:
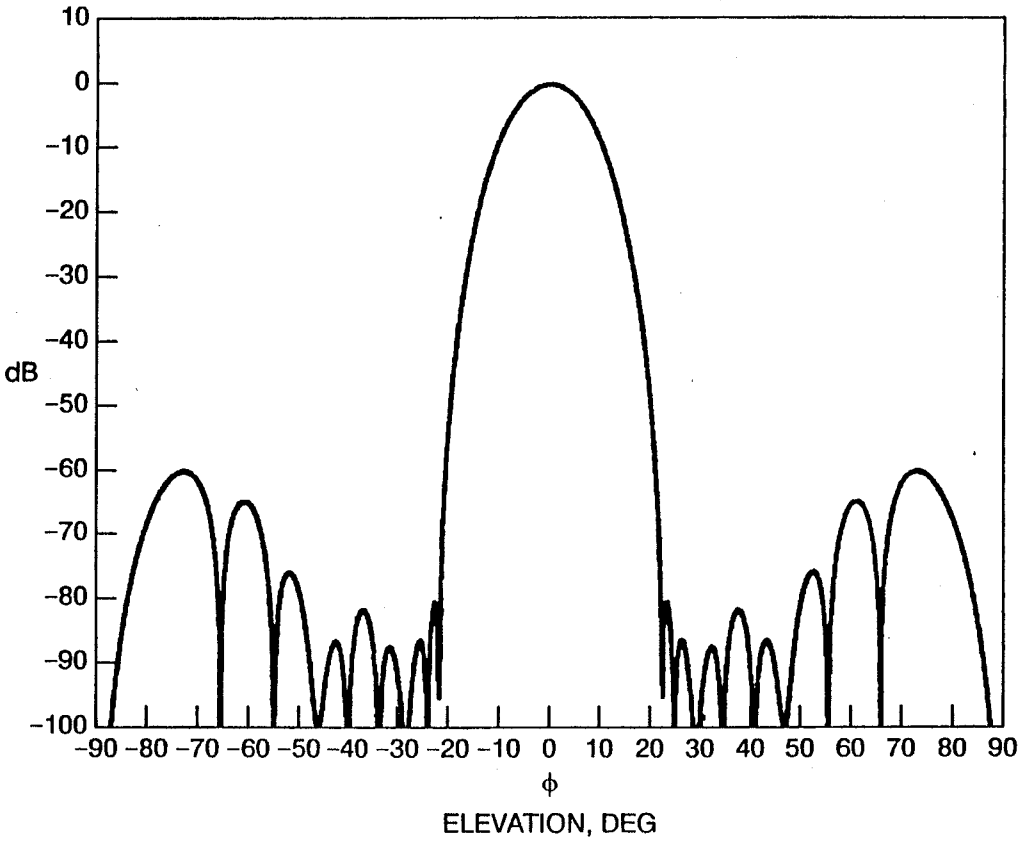
FIG. 5(*a*) is a simulated radiation pattern of the second preferred embodiment in a principal plane showing variation in amplitude with azimuth angle.
Figure 5B:
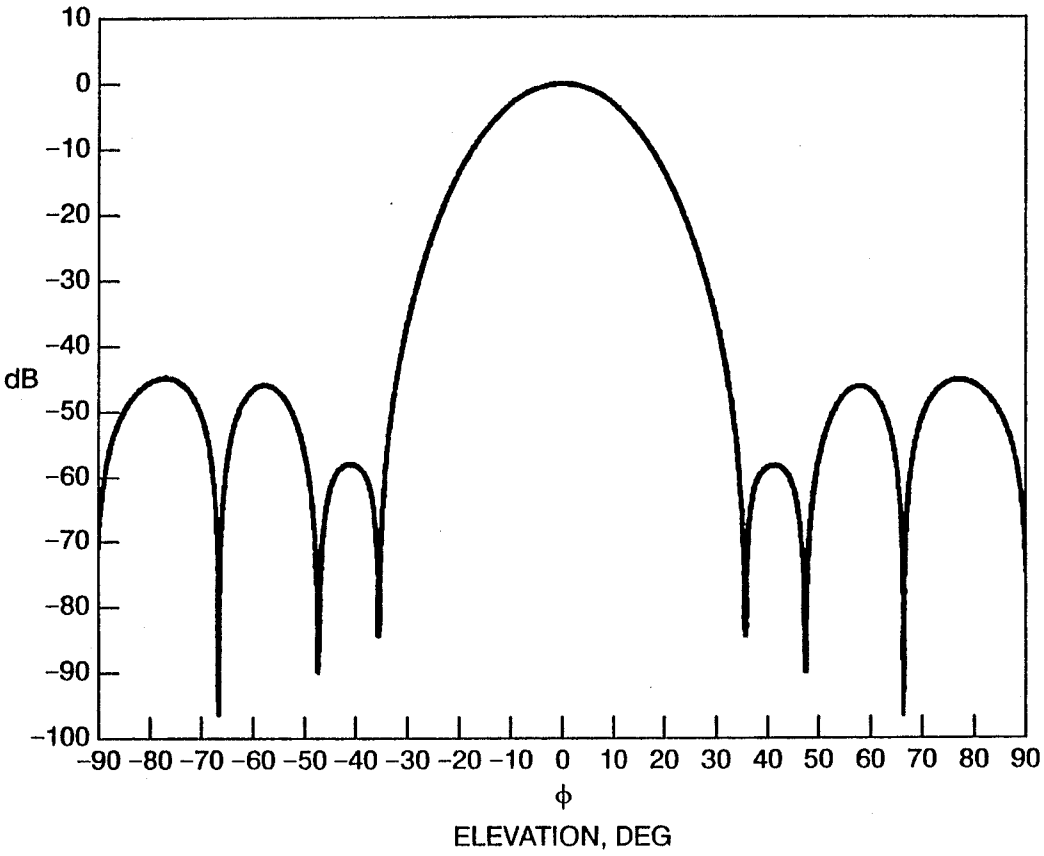

FIGS. 5(*a*)-(*b*) are plots of the radiation patterns in the two principal planes for an antenna according to a second preferred embodiment of the present invention. The second preferred embodiment is similar to the first preferred embodiment, except that the second preferred embodiment has only 11 rows, and 22 elements per row.

Figure 6A:
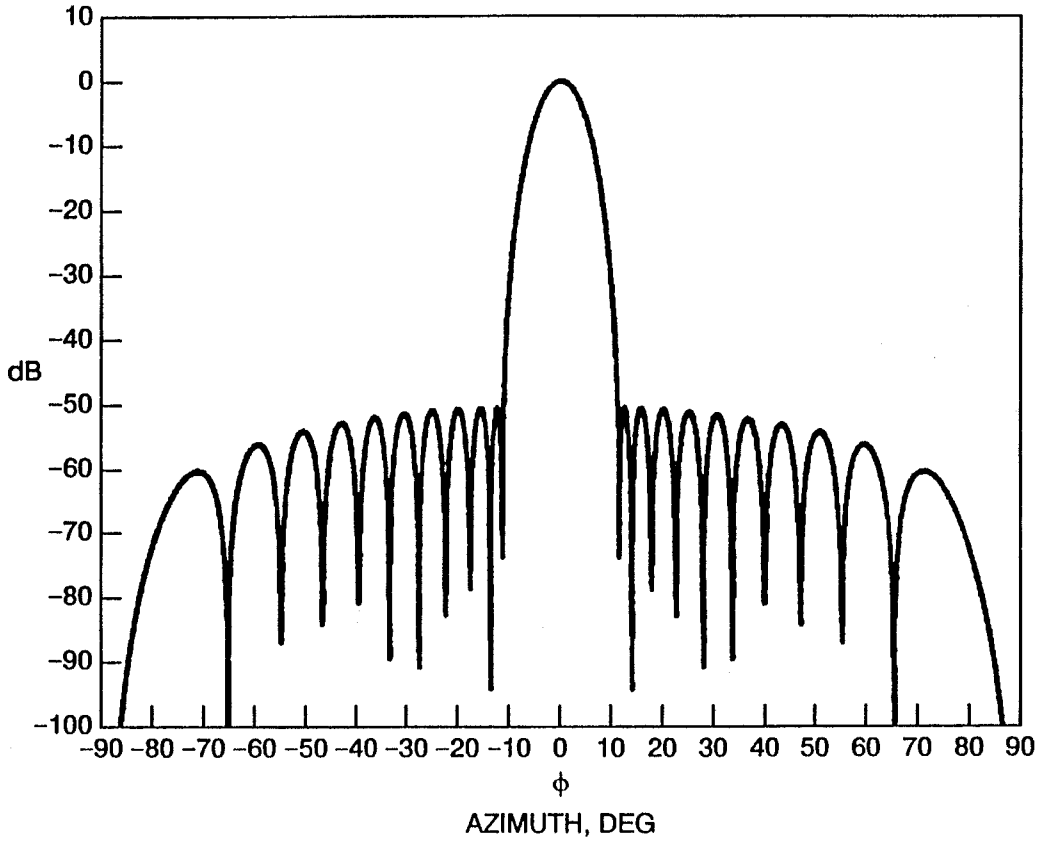
FIG. 6(*a*) is a simulated radiation pattern of another example planar array in a principal plane showing variation in amplitude with azimuth angle.
Figure 6B:
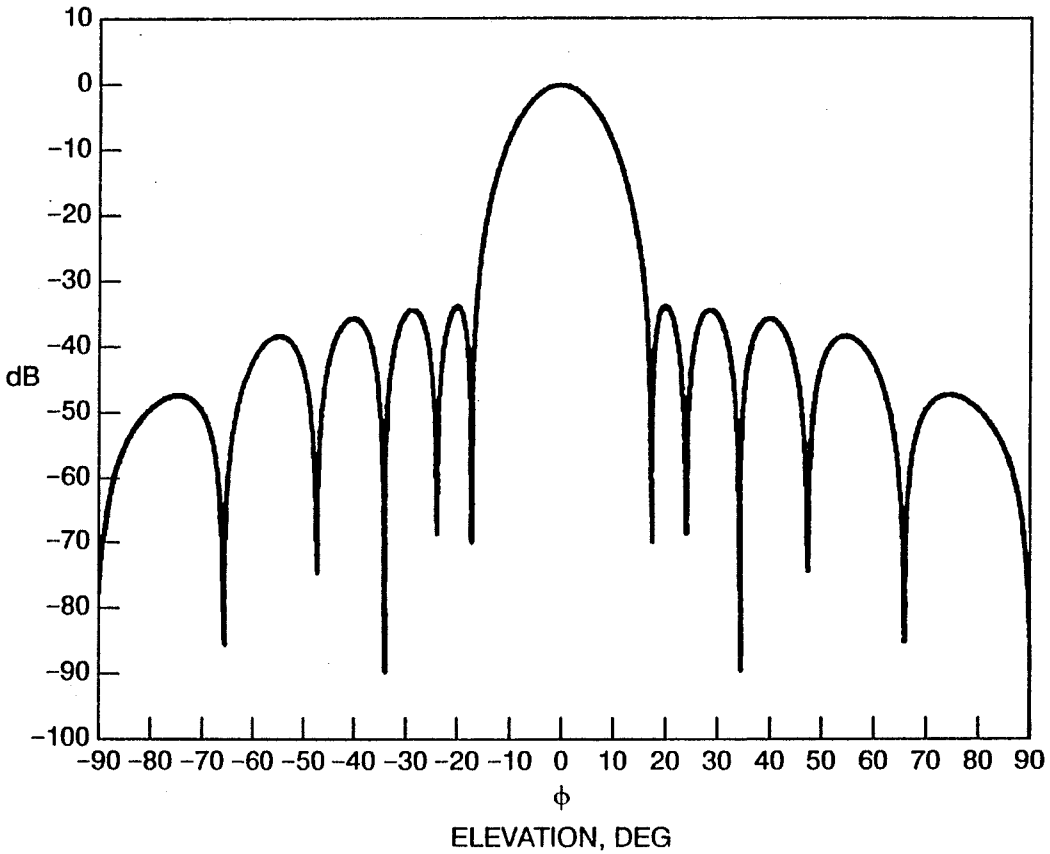

FIGS. 6(*a*)-(*b*) are plots of the radiation patterns in the two principal planes for an example planar array having 22 rows, and 11 elements per row. Comparing FIGS. 5(*a*)-(*b*) to 6(*a*)-(*b*) shows that the second preferred embodiment has reduction in sidelobe amplitude close to the main beam, similar to that of the first embodiment. In the second preferred embodiment, however, there is an insufficient number of elements to obtain a sidelobe level of −50 dB in elevation, as was obtained in the first preferred embodiment, and only −33 dB was obtained.

The preferred embodiments of the invention include a phased-array matched corporate feed network to provide for beam steering without moving a mechanical structure. The angle of the beam of each row will be a function of both the phase difference between adjacent elements used to steer the beam, using techniques well known in the art, and the orientation angle of the row relative to the nominal plane.

To steer the beam, each linear array includes an array signal path to the radio signal processor, and a plurality of elements. Each array signal path includes a plurality of element signal paths, each corresponding to a respective element, each element signal path includes means for introducing a steering phase shift relative to an adjacent element signal path, into the element signal path.

As the beam is steered to an angle varying from a normal to the nominal plane, the radiation pattern corresponding to FIGS. 4(*a*)-(*c*) will vary, but the sidelobes will still tend to be lower than those of a conventional planar array steered to the angle.

Figure 7:
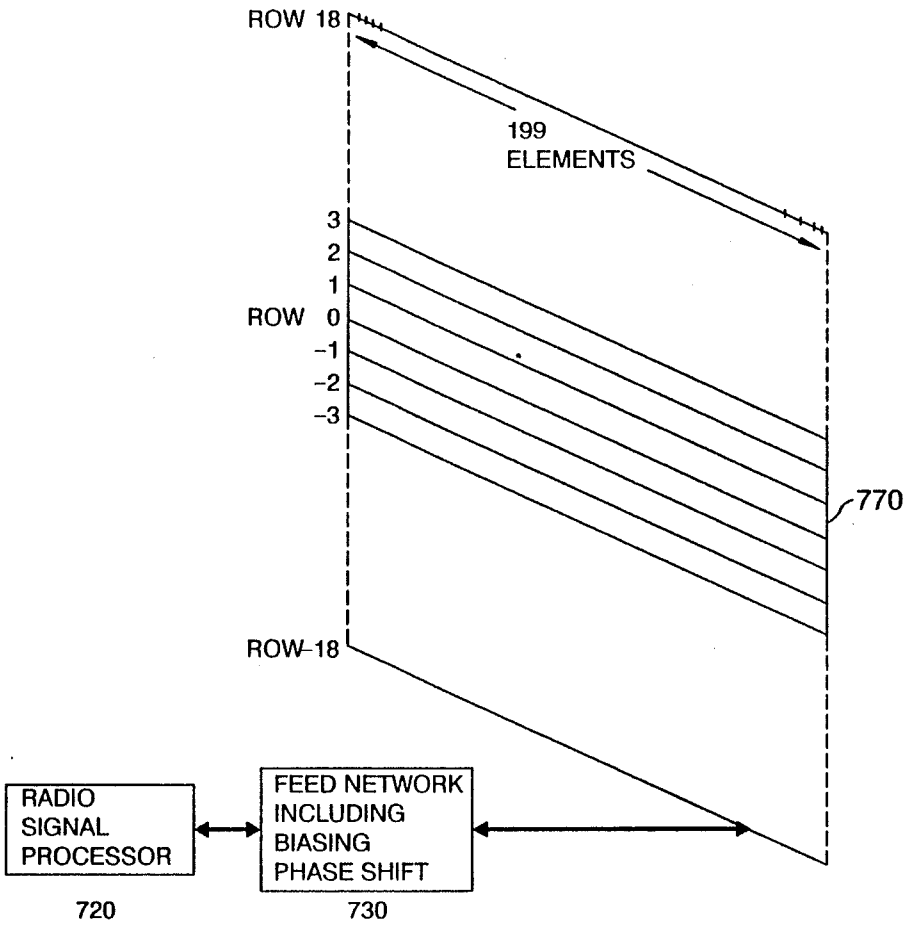
FIG. 7 is schematic diagram of an antenna system according to a third preferred embodiment of the present invention.

FIG. 7 is a schematic diagram of an antenna system according to a third preferred embodiment of the present invention. In this third preferred embodiment a conventional planar array mechanical structure is employed. Instead of mechanically pointing the beam of each row as was done in the first and second preferred embodiments, the beam of each row is pointed, or biased, at an angle relative to an adjacent row by a constant phase shift between adjacent elements in the rows.

In other words the third preferred embodiment includes a first array signal path between the first linear array and the radio signal processor, having a phase shift between adjacent elements, a second array signal path between the second linear array and the signal processing means, and an Nth array signal path between the Nth linear array and the signal processing means The first means for pointing includes means for introducing a biasing phase shift, different from the phase shift in the first array signal path, between adjacent elements in the second array signal path, and the Nth means for pointing includes means for introducing a biasing phase shift, relative to the (N−1)th array signal path, between adjacent elements in the Nth array signal path.

An advantage of the third preferred embodiment is that if the center operating frequency of antenna operation should change, no mechanical change is required in the antenna. Instead, the relative phase shift between rows would be varied electronically. Conversely, an advantage of the first and second preferred embodiments is that high resolution phase shifters are not required to bias the relative angles of the rows.

In the third preferred embodiment, introduction of the constant phase shift between adjacent elements of the rows means that there will be a second constant phase shift between adjacent elements of the columns.

Similar to the first and seconds preferred embodiments, the third preferred embodiment including a phased-array feed network. The beam direction of each row relative to the nominal plane is a function of both the phase shift used to steer the beam to an angle, using techniques well known in the art, and the phase shift used to bias the beam relative to the nominal scan angle.

In other words, to steer the beam in the third preferred embodiment, each linear array includes a plurality of elements, and each array signal path includes a plurality of element signal paths, each corresponding to a respective element. Each element signal path includes means for introducing a steering phase shift, relative to an adjacent element signal path, into the element signal path. The means for introducing a biasing phase shift between adjacent elements in the second array signal path is coupled to each means for introducing a steering phase shift in the element signal paths of the second array signal path, and the means for introducing a biasing phase shift between adjacent elements in the Nth array signal path is coupled to each means for introducing a steering phase shift into the element signal paths of the Nth array signal path.

Figure 8:
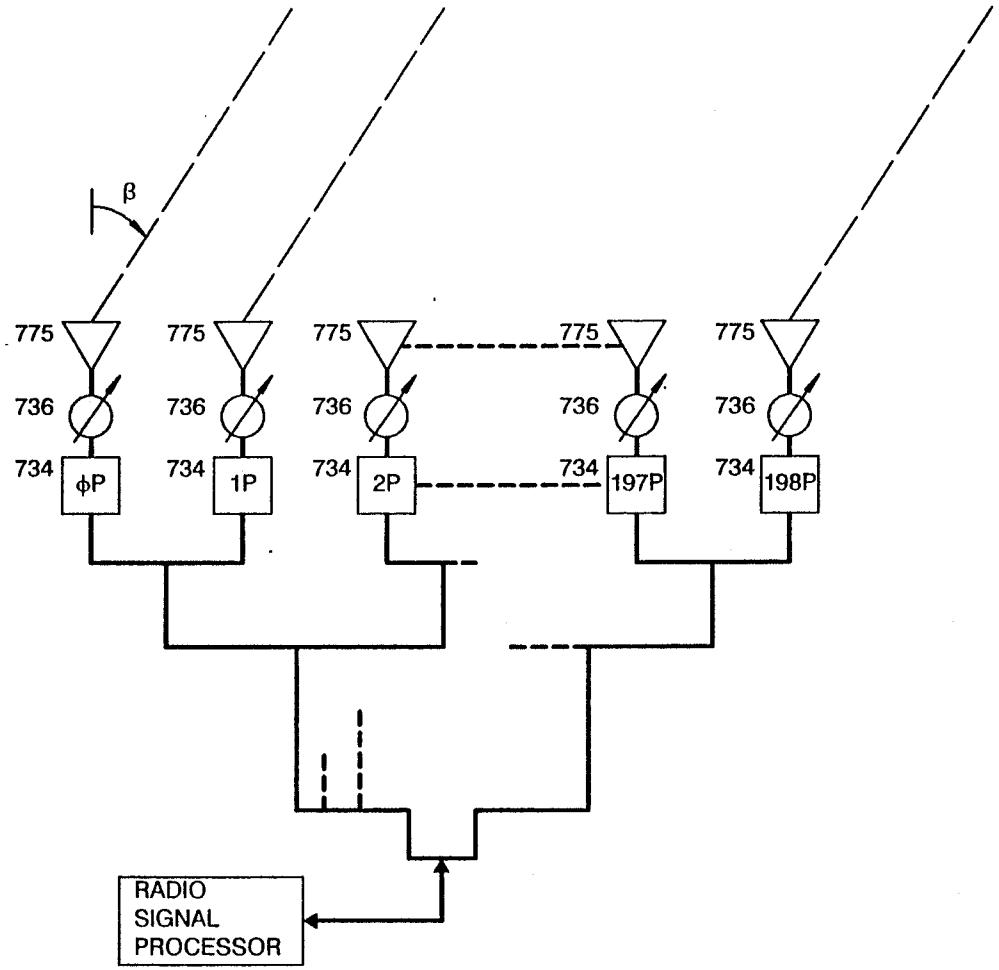
FIG. 8 is an expanded view of FIG. 7 emphasizing the feed network of one row of antenna 770.

FIG. 8 is a schematic diagram a row of the feed network of the third preferred embodiment, wherein each antenna element 775 has a pair of phase shifters, i.e., a biasing phase shifter 734 in series with a steering phase shifter 736. Each of these pairs of phase shifters could be implemented with a single physical phase shifter, programmed with a phase shift equal to the sum of the biasing phase shift and the steering phase shift for the respective element. Alternatively, each phase shifter may be implemented as a respective physical phase shifter because, as the biasing phase shift requires high resolution and low range compared to the steering phase shifter, separate physical shifters would not require a single high resolution and high range physical shifter in order to implement both phase shifts, thereby minimizing bit resolution requirements.

An additional advantage of the third preferred embodiment is that it could be implemented on an existing phased-array with software modifications, assuming that each phase shifter pair could be implemented with a single physical phase shifter, as discussed above.

The row of elements shown in FIG. 8 is biased at an angle $\beta$ relative to an adjacent row (not shown). (To facilitate explanation, $\beta$ is shown exaggerated in FIG. 8.) The phase shift factor P of biasing phase shifters 734 is given by:

$$P = \frac{2\pi d}{W} \text{SIN}\beta,$$

wherein d is the spacing between elements.

Figure 9A:
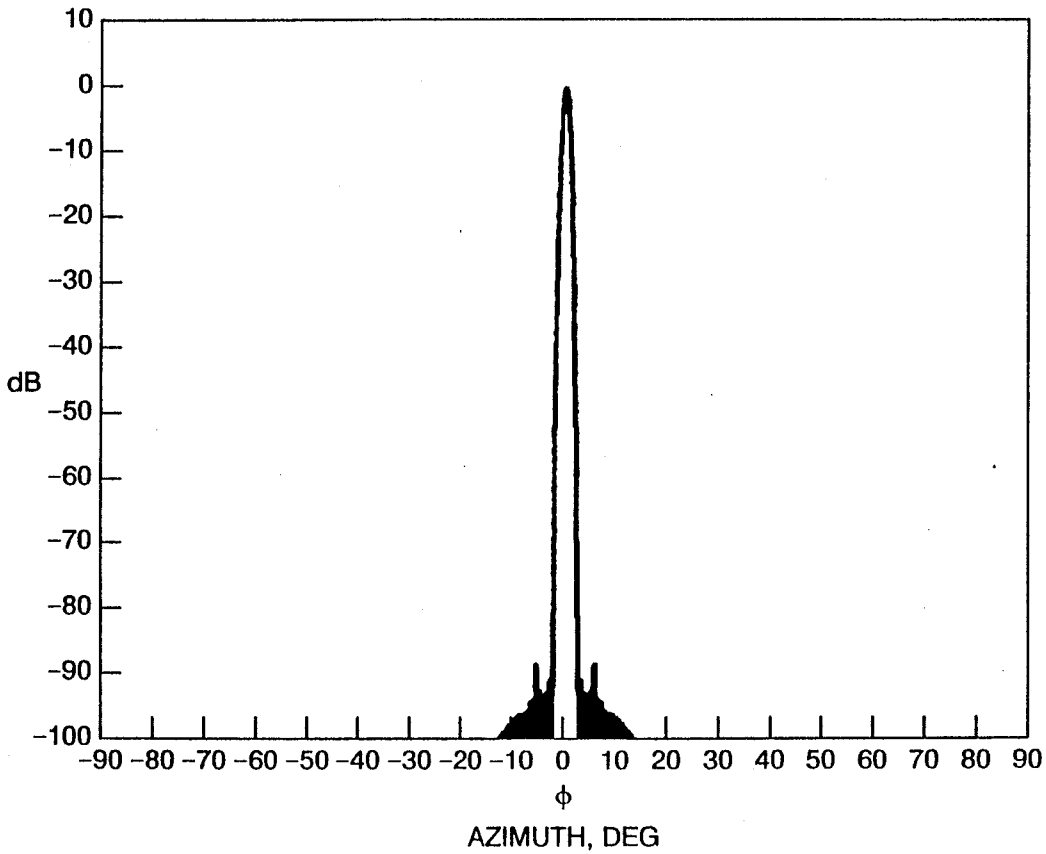
FIG. 9(*a*) is a simulated radiation pattern of the third preferred embodiment in a principal plane having a varying azimuth angle.
Figure 9B:
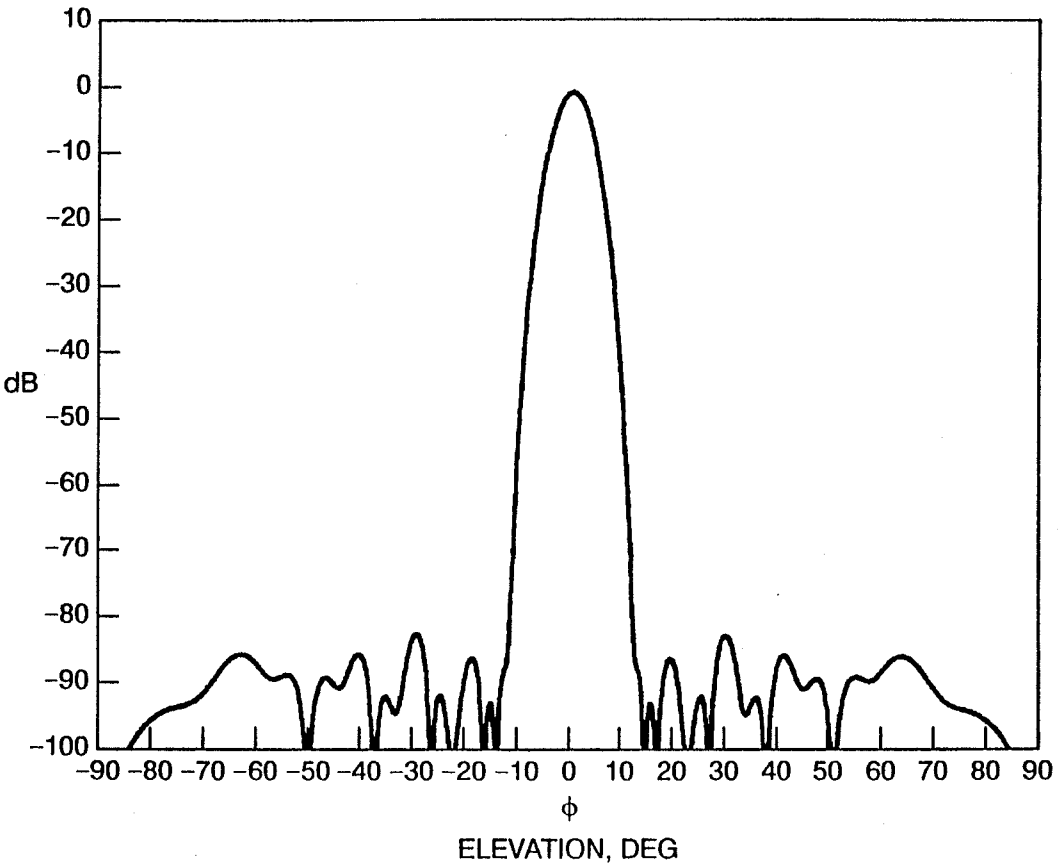

FIGS. 9(*a*)–(*b*) are plots of the radiation pattern in the two principal planes of the third preferred embodiment.

Each of the first, second, and third preferred embodiments has similar characteristics in comparison to a corresponding planar array. The width of the main beam is increased. There is a substantial reduction in the amplitude of the principal plane sidelobes, and an increase in the sidelobes in two bands on either side of the principal planes.

It is contemplated that the preferred embodiments be deployed in environments such as those discussed in the background of the invention. The contemplated environments include those where the target antenna and the other antennas can be aligned with a principal plane of the antenna system of a preferred embodiment. The contemplated environments include those where the target and other antennas tend to be on a common horizon. The contemplated environments also include those where the target and other antennas are on the equator and a preferred embodiment is in geosynchronous orbit, or where a preferred embodiment is on the equator and the target and other antennas are in geosynchronous orbits.

Additional advantages and modifications will readily occur to those skilled in the art. The invention in its broader aspects is therefore not limited to the specific details, representative apparatus, and illustrative examples shown and described. For example, although the preferred embodiments are based on rectangular planar geometries, embodiments may be based on non-planar geometries, such as cylindrical geometries for example. Further, improved radiation pattern may be obtained by increasing the total number of antenna elements.

Accordingly, departures may be made from the details described without departing from the spirit or the scope of applicants' general inventive concept. It is intended that the present invention cover the modifications and variations provided they come within the scope of the appended claims and their equivalents.

What is claimed is:

1. An antenna having N subantennas, N being at least 3, each subantenna having a pattern having a main lobe and sidelobes on opposite sides of the main lobe, each pattern lying in a plane parallel to, and removed from, a pattern of an adjacent subantenna, comprising:

a first subantenna;

a second subantenna;

first means for pointing the pattern of the second subantenna at a non-zero angle relative to the pattern of the first subantenna; and an Nth subantenna;

(N−1)th means for pointing the pattern of the Nth antenna at the non-zero angle relative to the pattern of the (N−1)th antenna.

2. The antenna of claim 1, further including an axis common to each of the N subantennas, and wherein each subantenna further includes a linear array of elements each having two endpoints and a longitudinal axis of length L between said endpoints normal to the common axis having a midpoint intersecting the common axis.

3. An antenna having N subantennas defining a common axis, N being an off number, N being at least 3, each subantenna including a linear array of elements each having 2 endpoints and a longitudinal axis of length L between said endpoints normal to the common axis having a midpoint intersecting the common axis, each subantenna having by a pattern having a main lobe and sidelobes on opposite sides of the main lobe, each pattern lying in a plane parallel to, and removed from, a pattern of an adjacent subantenna, comprising:

a first subantenna;

a second subantenna;

first means for pointing the pattern of the second subantenna at a non-zero angle relative to the pattern of the first subantenna;

an Nth subantenna;

(N−1)th means for pointing the pattern of the Nth antenna at the non-zero angle relative to the pattern of the (N−1)th antenna; and means, coupled to the linear arrays, for processing a radio frequency signal having a center operating frequency, and a wavelength W corresponding to the center operating frequency, wherein the non-zero angle is ARCSIN (W/(L/2)) divided by (((N+1)/2)−1).

4. The antenna of claim 3, wherein the first means for pointing includes means for mechanically orienting the second antenna at the non-zero angle relative to the mechanical orientation of the first antenna, and wherein the (N−1)th means for pointing includes means for mechanically orienting the Nth antenna at the non-zero angle relative to the mechanical orientation of the (N−1)th antenna.

5. The antenna of claim 4, wherein each linear array includes an array signal path to the processing means, and a plurality of elements, and each array signal path includes a plurality of element signal paths, each corresponding to a respective element, each element signal path including means for introducing a steering phase shift, relative to an adjacent element signal path, into the element signal path.

6. The antenna of claim 3, further including a first array signal path between the first linear array and the processing means, the first array signal path having a phase shift between adjacent elements;

a second array signal path between the second linear array and the signal processing means;

an Nth array signal path between the Nth linear array and the signal processing means, wherein the first means for pointing includes means for introducing a biasing phase shift, different than the phase shift in the first array signal path, between the elements in the second array signal path, and wherein the Nth means for pointing includes means for introducing a biasing phase shift, different than the phase shift in the (N−1)th array signal path, between the elements in the Nth array signal path.

7. The antenna of claim 6, wherein each linear array includes a plurality of elements, and each array signal path includes a plurality of element signal paths, each corresponding to a respective element, each element signal path including means for introducing a steering phase shift, relative to an adjacent element signal path, into the element signal path.

8. The antenna of claim 7, wherein the means for introducing the biasing phase shift between elements in the second array signal path is coupled to each means for introducing a steering phase shift in the element signal paths of the second array signal path, and wherein the means for introducing the biasing phase shift between elements in the Nth array signal path is coupled to each means for introducing the steering phase shift into the element signal paths of the Nth array signal path.

9. The antenna of claim 8, wherein each linear array has M equally spaced elements.

10. The antenna of claim 8, wherein N is larger than 10 and M is larger than 20.

11. The antenna of claim 9, wherein N is 39 and M is 199.

12. An antenna having N subantennas, N being at least 3, each subantenna having a pattern having a main lobe and sidelobes on opposite sides of the main lobe, each pattern lying in a plane parallel to, and removed from, a pattern of an adjacent subantenna, comprising:

a first subantenna;

a second subantenna;

first means for pointing the pattern of the second antenna at a non-zero angle relative to the pattern of the first subantenna;

an Nth subantenna; and (N−1)th means for pointing the pattern of the Nth antenna at the non-zero angle relative to the pattern of the (N−1)th antenna, wherein each subantenna further includes a linear array of elements each having a longitudinal axis of length L, and the antenna further includes means, coupled to the linear arrays, for processing a radio frequency signal having a center operating frequency, and a wavelength W corresponding to the center operating frequency, wherein the non-zero angle is ARCSIN (DW/(L/2)) divided by (((N+1)/2)−1), wherein N is an odd number and D is a positive integer.

13. The antenna of claim 12, wherein the first means for pointing includes means for mechanically orienting the second antenna at the non-zero angle relative to the mechanical orientation of the first antenna, and wherein the (N−1)th means for pointing includes means for mechanically orienting the Nth antenna at the non-zero angle relative to the mechanical orientation of the (N−1)th antenna.

14. The antenna of claim 13, wherein each linear array includes an array signal path to the processing means, and a plurality of elements, and each array signal path includes a plurality of element signal paths, each corresponding to a respective element, each element signal path including means for introducing a steering phase shift, relative to an adjacent element signal path, into the element signal path.

15. The antenna of claim 12, further including a first array signal path between the first linear array and the processing means, the first array signal path having a phase shift;

a second array signal path between the second linear array and the signal processing means;

an Nth array signal path between the Nth linear array and the signal processing means, wherein the first means for pointing includes means for introducing a biasing phase shift, relative to the first array signal path, between elements in the second array signal path, and wherein the Nth means for pointing includes means for introducing a biasing phase shift, relative to the (N−1)th array signal path, between elements in the Nth array signal path.

16. The antenna of claim 15, wherein each linear array includes a plurality of elements, and each array signal path includes a plurality of element signal paths, each corresponding to a respective element, each element signal path including means for introducing a steering phase shift, relative to an adjacent element signal path, into the element signal path.

17. The antenna of claim 16, wherein the means for introducing the biasing phase shift between elements in the second array signal path is coupled to each means for introducing the steering phase shift in the element signal paths of the second array signal path, and wherein the means for introducing the biasing phase shift between elements in the Nth array signal path is coupled to each means for introducing the steering phase shift into the element signal paths of the Nth array signal path.

18. The antenna of claim 17, wherein each linear array has M equally spaced elements.

19. The antenna claim 17, wherein N is larger than 10 and M is larger than 20.

20. The antenna of claim 18, wherein N is 39 and M is 199.

21. An antenna having N subantennas, N being at least 3, each subantenna having a pattern having a main lobe and sidelobes on opposite sides of the main lobe, each pattern lying in a plane parallel to, and removed from, a pattern of an adjacent subantenna, comprising:

a first subantenna a second subantenna;

first means for pointing the pattern of the second antenna at a non zero angle relative to the pattern of the first subantenna;

an Nth subantenna;

(N−1)th means for pointing the pattern of the Nth antenna at the non zero angle relative to the pattern of the (N−1)th antenna; and an axis common to each of the N subantennas, wherein each subantenna further includes a linear array of elements each having two endpoints and a longitudinal axis of length L between the endpoints normal to the common axis having a midpoints intersecting the common axis;

wherein the antenna further includes means, coupled to the linear arrays, for processing a radio frequency signal having a center operating frequency, and a wavelength W corresponding to the center operating frequency; and a nominal plane, defined by the common axis and the longitudinal axis of the (N+1)/2 th array, wherein the non-zero angle is selected so that the corners of the antenna will be separated from the nominal plane by a distance of DW, wherein D is a number.

22. An antenna having N subantennas, N being at least 3, each subantenna having a pattern having a main lobe and sidelobes on opposite sides of the main lobe, each pattern lying in a plane parallel to, and removed from, a pattern of an adjacent subantenna, comprising:

a first subantenna;

a second subantenna;

first means for pointing the pattern of the second subantenna at a non-zero angle relative to the pattern of the first subantenna;

an Nth subantenna;

(N−1)th means for pointing the pattern of the Nth antenna at the non-zero angle relative to the pattern of the (N−1)th antenna; and an axis common to each of the N subantennas, wherein each subantenna further includes a linear array of elements each having two endpoints and a longitudinal axis of length L between the endpoints normal to the common axis having a midpoint intersecting the common axis;

wherein the antenna further includes means, coupled to the linear arrays, for processing a radio frequency signal having a center operating frequency, and a wavelength W corresponding to the center operating frequency;

a nominal plane, defined by the common axis and the longitudinal axis of the (N+1)/2 th array; and a center axis normal to the common axis and lying in the nominal plane, wherein the non-zero angle is selected so that the corners of the antenna will be separated from the nominal plane by a distance of DW, wherein D is a number, and wherein for each subantenna having a non-zero displacement C from the center axis and having a radiation pattern biased at an angle A relative to the nominal plane, there is a similar subantenna having a displacement −C from the center axis and having a radiation pattern biased at an angle −A relative to the nominal plane.

23. The antenna of claim 22, wherein D is 8 or less.

24. The antenna of claim 22, wherein D is an integer.

25. The antenna of claim 22, wherein D is 1.

26. In an antenna having N subantennas defining a common axis, N being at least 3, each subantenna having a pattern having a main lobe and sidelobes on opposite sides of the main lobe, each pattern lying in a plane parallel to, and removed from, a pattern of an adjacent subantenna, each subantenna including a linear array of elements each having two endpoints and a longitudinal axis of length L between the endpoints normal to the common axis having a midpoint intersecting the common axis, wherein the antenna further includes means, coupled to the linear arrays, for processing a radio frequency signal having a center operating frequency, and a wavelength W corresponding to the center operating frequency, and a nominal plane, defined by the common axis and the longitudinal axis of the (N+1)/2 th array, a method of operating the antenna comprising the steps of:

pointing the pattern of a second subantenna at a non zero angle relative to the pattern of a first subantenna; and pointing the pattern of the Nth subantenna at the non zero angle relative to the pattern of the (N−1)th subantenna, wherein the non-zero angle is selected so that the corners of the antenna will be separated from the nominal plane by a distance of DW, wherein D is a number.

27. The method of claim 26, wherein the antenna further includes a center axis normal to the common axis and lying in the nominal plane, wherein for each step of pointing a subantenna having a non-zero displacement C from the center axis and having a radiation pattern biased at an angle A relative to the nominal plane, comprises the substep of pointing the pattern of similar subantenna having a displacement −C from the center axis and having a radiation pattern biased at an angle −A relative to the nominal plane.

28. The method of claim 27, further including the step of selecting D to be 8 or less.

29. The method of claim 27, further including the step of selecting D to be an integer.

30. The method of claim 27, further including the step of selecting D to be 1.

31. The method of claim 27, wherein the antenna has a principal plane containing both an electric field vector and a direction of maximum radiation, and the method further includes the step of aligning the principal plane with a horizon.

32. The method of claim 27, wherein the antenna has a principal plane containing both an electric field vector and a direction of maximum radiation, and the method further includes the step of aligning the principal plane with an equator.

33. The method of claim 27, wherein the antenna has a principal plane containing both a magnetic field vector and a direction of maximum radiation, and the method further includes the step of aligning the principal plane with a horizon.

34. The method of claim 27, wherein the antenna has a principal plane containing both a magnetic field vector and a direction of maximum radiation, and the method further includes the step of aligning the principal plane with an equator.

* * * * *

UNITED STATES PATENT AND TRADEMARK OFFICE

CERTIFICATE OF CORRECTION

PATENT NO. : 5,151,705

DATED : September 29, 1992

INVENTOR(S) : Scott L. Badger, et. al.

It is certified that error appears in the above-indentified patent and that said Letters Patent is hereby corrected as shown below:

Column 9, Claim 3, line 2, change "off" to --odd--.

Column 11, Claim 21, line 6, after "subantenna" insert --;--.

Signed and Sealed this

Twenty-eighth Day of September, 1993

Bruce Lehman

*Attest:*

BRUCE LEHMAN

*Attesting Officer*

*Commissioner of Patents and Trademarks*